United States Patent [19]

Haberlin et al.

[11] 4,186,005

[45] Jan. 29, 1980

[54] PHOTOGRAPHIC PRODUCTS AND PROCESSES EMPLOYING ROLL FILM WITH ACID BACKING LAYER

[75] Inventors: Richard J. Haberlin, Weston; Robert K. Stephens, Burlington, both of Mass.

[73] Assignee: Polaroid Corporation, Cambridge, Mass.

[21] Appl. No.: 592,613

[22] Filed: Jul. 2, 1975

Related U.S. Application Data

[63] Continuation-in-part of Ser. No. 401,683, Sep. 28, 1973, abandoned, which is a continuation of Ser. No. 249,696, May 1, 1972, abandoned, which is a continuation-in-part of Ser. No. 54,176, Jul. 13, 1970, abandoned, and Ser. No. 54,170, Jul. 13, 1970, abandoned.

[51] Int. Cl.[2] ..... G03C 5/54; G03C 1/48; G03C 3/02; G03C 5/24

[52] U.S. Cl. ..... 430/228; 430/233; 430/231; 430/246; 430/216

[58] Field of Search ..... 96/76 R, 78, 64, 29 R, 96/3, 25, 80

[56] References Cited

U.S. PATENT DOCUMENTS

| | | | |
|---|---|---|---|
| 2,740,717 | 4/1956 | Yutzy et al. | 96/76 R |
| 2,882,151 | 4/1959 | Yutzy et al. | 96/76 R |
| 3,220,841 | 11/1965 | Stevens | 96/78 |
| 3,240,604 | 3/1966 | Cook | 96/78 |
| 3,313,625 | 4/1967 | Ryan | 96/76 R |
| 3,615,127 | 10/1971 | Land | 352/130 |
| 3,615,426 | 10/1971 | Debruyn | 96/76 R |
| 3,677,753 | 7/1972 | Francis et al. | 96/76 R |

OTHER PUBLICATIONS

*The Focal Encyclopedia of Photography*, c1969, Desk Edition, McGraw-Hill Book Co., N.Y. pp. 50 and 371.

*Primary Examiner*—Richard L. Schilling
*Attorney, Agent, or Firm*—Philip G. Kiely

[57] ABSTRACT

This invention is directed to a film unit composed of a support carrying on one side a processing composition permeable layer containing an acid reacting reagent therein, and, on the other side, silver precipitating nuclei and photosensitive silver halide crystals. The above film unit is particularly suitable for use as motion picture film, i.e., in the form of an elongated web wherein said film unit is unwound, exposed, contacted with a photographic processing composition containing, e.g., a silver halide developing agent and silver halide solvent, rolling said film unit upon itself thereby contacting the processing composition permeable layer with the layers on the opposite side of the support. The acid reacting agent will diffuse into the silver halide and nuclei containing layers providing enhanced stability to the film unit.

In a preferred embodiment, the film unit of the present invention includes an additive color screen intermediate the support and the silver precipitating nuclei and photosensitive silver halide crystals.

9 Claims, 6 Drawing Figures

PHOTOGRAPHIC PRODUCTS AND PROCESSES EMPLOYING ROLL FILM WITH ACID BACKING LAYER

CROSS REFERENCE TO OTHER APPLICATIONS

This application is a continuation-in-part of application Ser. No. 401,683, filed Sept. 28, 1973, now abandoned, which is in turn a continuation of application Ser. No. 249,696, filed May 1, 1972, now abandoned, which in turn is a continuation-in-part of applications Ser. Nos. 54,167 and 54,170, filed July 13, 1970, now abandoned.

BACKGROUND OF THE INVENTION

Procedures for preparing photographic images in silver by diffusion transfer principles are well know in the art. For the formation of the positive silver images, a latent image contained in an exposed photosensitive silver halide emulsion is developed and almost concurrently therewith, a soluble silver complex is obtained by reaction of a silver halide solvent with the unexposed and undeveloped silver halide of said emulsion. Preferably, the photosensitive silver halide emulsion is developed with a processing composition in a viscous condition which is spread between the photosensitive element comprising the silver halide emulsion and a print-receiving element comprising, preferably, a suitable silver precipitating layer. The processing composition effects development of the latent image in the emulsion and, substantially contemporaneously therewith, forms a soluble silver complex, for example, a thiosulfate or thiocyanate, with undeveloped silver halide. This soluble silver complex is, at least in part, transported in the direction of the print-receiving element and the silver thereof is largely precipitated in the silver precipitating element to form a positive image thereon. Procedures of this description are disclosed, for example, in U.S. Pat. No. 2,543,181 issued to Edwin H. Land. See, also, Edwin H. Land, *One Step Photography,* Photographic Journal, Section A, pp. 7–15, January 1950.

Additive color reproduction may be produced by exposing a photosensitive silver halide emulsion through an additive color screen having film media or screen elements each of an individual additive color, such as red or green or blue, and by viewing the reversed or positive silver image formed by transfer to a transparent print-receiving element through the same or a similar screen which is suitably registered with the reversed positive image carried by the print-receiving layer.

As examples of suitable film structures for employment in additive color photography, mention may be made of U.S. Pat. Nos. 2,861,885; 2,726,154; 2,944,894; 3,536,488; 3,615,427; 3,615,428; 3,615,429; and 3,615,426.

The above-mentioned film units are disclosed to be particularly desirable for employment as a cine film for motion picture projection by reason of the inherent ability to simply and effectively process such a film employing relatively simple and stable processing compositions immediately subsequent to exposure without the necessity of providing a process and apparatus adapted to effect stripping of a separate emulsion stratum in the remainder of the film unit to provide information recordation possessing the image integrity in reproduction characteristics required for effective employment of the film Such a film assemblage is suitably employed in a motion picture system such as that described in U.S. Pat. No. 3,615,127 issued Oct. 26, 1971, which comprises a compact motion picture cassette capable of performing the functions of exposing a photosensitive film contained therein and subsequently processing the film to develop images recorded thereon and also projecting the images or otherwise presenting them for viewing purposes. Thus, the film assemblage may be exposed, chemically processed, dried if necessary, and projected without transferring the film from its original container to any other container or even removing the film from the original cassette. The motion picture system of U.S. Pat. No. 3,615,127 includes a film processing station whereupon the exposed film strip is passed from the take-up reel, past an applicator where a moist film developing composition to develop to a visible condition images recorded on said film is applied and thence to a second reel.

The processing compositions may be applied to the films by a variety of methods such as, for example, doctor blades, extrusion heads, capillary applicators, wicks, and the like. The amount of processing composition applied to the film assemblage must be controlled within relatively narrow limits, however. Sufficient processing composition must be applied to adequately and completely permeate the film assemblage to the depth necessary and in the quantity necessary to provide the desired negative and positive images.

The processing composition employed will include an alkaline material, for example, sodium hydroxide, potassium hydroxide, sodium carbonate, or the like, and most preferably, in a concentration providing a pH to the processing composition in excess of about 12. The processing composition may, if desired, contain the sole silver halide developing agent or agents employed or a silver halide developing agent in addition to that disposed as in the film unit. The relative proportions of the agents comprising the developing composition may be altered to suit the requirements of the operator. Thus, the developing composition may be modified by the employment of preservatives, alkalis, silver halide solvents, etc., other than those specifically mentioned. When desirable it is also contemplated to include in the developing composition components such as restrainers, accelerators, and the like. The concentration of such agents may be varied over relatively wide range commensurate with the art.

A novel film unit has now been found which is not susceptible to the deficiencies of the prior art.

SUMMARY OF THE INVENTION

The present invention is directed to a photographic film unit comprising a support carrying on a first surface silver precipitating nuclei and photosensitive silver halide crystals and, on a second surface, a stabilizing layer composed of a processing composition permeable layer which contains an acid reacting reagent disposed therein. The abovementioned stabilizing layer is a hydrophilic processing composition permeable polymeric material which, in addition to initially retaining the aforementioned acid reacting reagents therein serves to absorb excess aqueous alkaline processing composition remaining on the opposite surface of the film unit as the film is rolled upon itself after the processing composition is applied. Thus, the novel composite film structure of the present invention is particularly suitable for use as motion picture film wherein the motion picture film is processed with a relatively small quantity of processing composition and rolled upon itself, with little or no drying, substantially immediately after the application of said processing composition. The hydrophilic polymeric material serves as a reservoir for excess processing composition, thus minimizing "squeeze out" or the extrusion of said excess from adjacent film structures as the film is wound up upon itself upon a take-up reel. As stated above, in the past, excess film lying on the surface of the film unit would be forced to the edges of the film strip, consequently contacting other parts of the machinery and flowing into the perforations in the film.

When the film unit is rolled upon itself, the hydrophilic processing composition permeable polymeric layer contacts the layers on the opposite side of the support, thus allowing the acid reacting reagent contained in said hydrophilic layer to diffuse into the layers which have been contacted with the processing composition.

In a particularly preferred embodiment, the film unit includes a multicolor additive color screen interposed between said support and said layers containing silver precipitating agents and the photosensitive silver halide crystals.

DETAILED DESCRIPTION OF THE INVENTION

Figure 1:
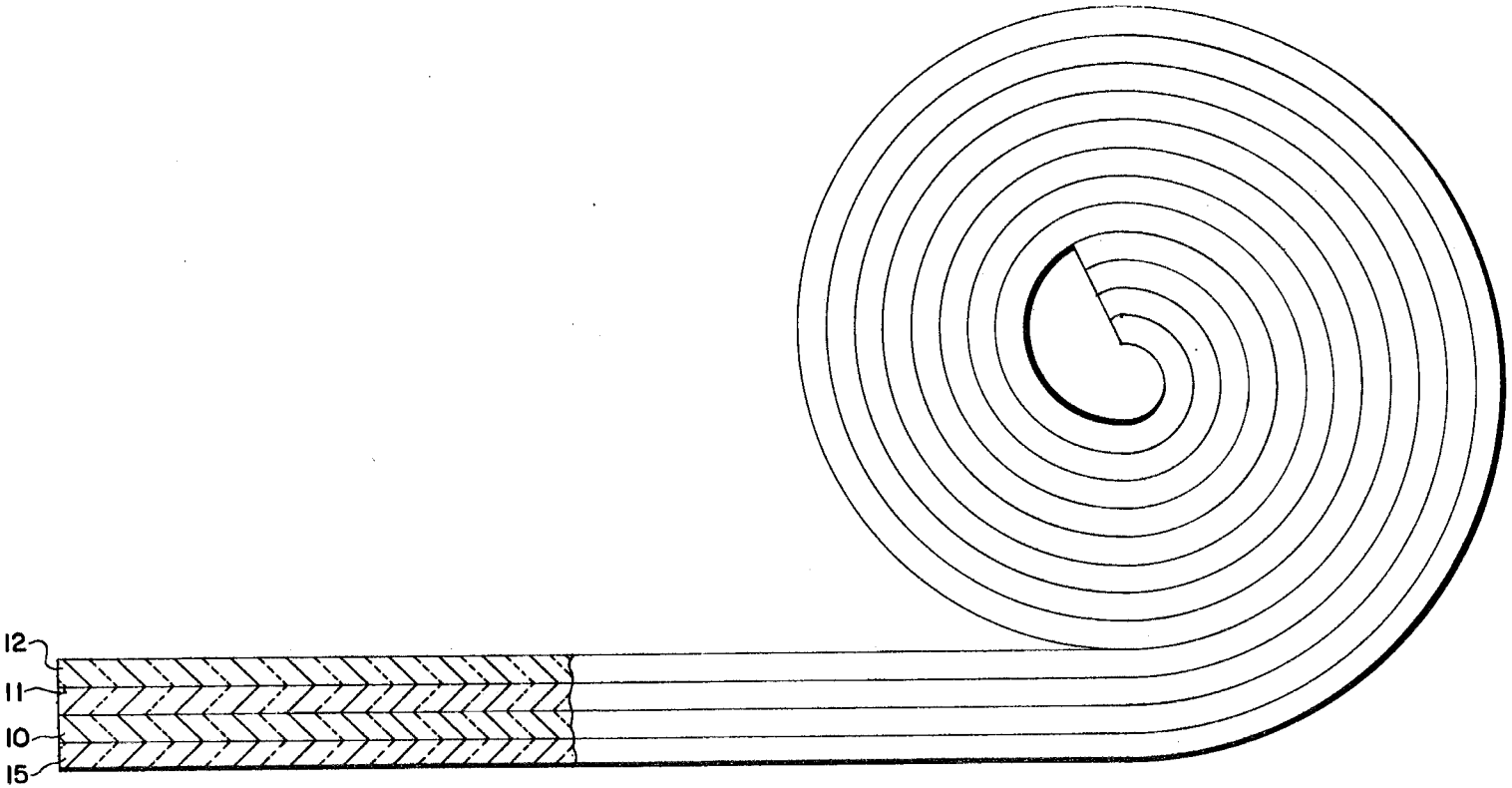
FIG. 1 is a diagrammatic enlarged cross-sectional view illustrating the photographic film unit of the present invention and the relationship of the layers constituting said film unit as it is rolled upon itself.

In accordance with the present invention, it has now been quite unexpectedly discovered that distinctly advantageous results may be achieved, particularly with respect to the stability of the silver image formed as a function of photosensitive silver halide exposure, by the employment of a film unit assemblage which comprises a permanently fixed laminate which includes a support carrying on a first surface silver precipitating nuclei and photosensitive silver halide crystals and, on the second surface of said support, a processing composition permeable layer containing an acid reacting reagent.

The above-mentioned film units are disclosed to be particularly desirable for employment as a cine film for motion picture projection by reason of the inherent ability to simply and effectively process such a film employing relatively simple and stable processing compositions immediately subsequent to exposure without the necessity of providing a process and apparatus adapted to effect stripping of a separate emulsion stratum in the remainder of the film unit to provide information recordation possessing the image integrity in reproduction characteristics required for effective employment of the film.

The processing composition permeable material has disposed therein an acid reacting reagent which when contacted with processing composition, is rendered available to neutralize the alkaline processing composition thus imparting stability and permanence to the thus-formed silver.

As stated above, the processing composition permeable material is hydrophilic in nature and is permeable to the processing composition. The processing composition permeable layer is preferably composed of a film-forming polymer which is inert to alkaline solution, is not photographically deleterious, that is, will not adversely affect the photographic properties of the total film assemblage, and is transparent. As examples of suitable polymeric materials, mention may be made of hydroxyalkyl ether substituted polymers, for example, hydroxymethyl cellulose, hydroxyethyl cellulose, hydroxypropyl cellulose; the hydroxyalkyl substituted vinyl polymers, such as hydroxyethyl polyvinyl alcohol and hydroxypropyl polyvinyl alcohol; gelatin and gelatin derivatives, polyvinyl alcohol and carboxymethyl cellulose. The processing composition permeable layer may also contain suitable inert fillers known to the art, such as silica, diatomaceous earth and the like. The filler is not critical and it is only necessary that the filler not deleteriously effect the absorbent properties of the layer or the photographic properties of the film unit.

The thickness of the layer of the polymeric material employed is not critical, but may be determined with respect to the quantity of developing solution necessary to provide the diffusion transfer image as well as the thickness and permeability of the layers of the photographic film assemblage, the photographic requirements of the film unit for processing composition, and the tolerance or accuracy inherent in the processing composition applicator. In a preferred embodiment, however, the layer of processing composition permeable material is between 50 and 200 mgs./ft.$^2$ thick. In preparing the novel film assemblage of the present invention, the layer of processing composition permeable material may be applied by conventional coating means directly on the support. Depending upon the employment of materials in forming the aforementioned subassemblage, it may be desirable to employ adhesion promoters to insure the adequate adhesion of the alkali-receptive layer to the support. For example, a suitable adhesive layer may be employed providing, however, such adhesive compositions are not photographically deleterious or otherwise interfere with the photographic properties of the film unit. If adhesion promoters are necessary, it is preferred that electrical discharge methods be employed to provide the adhesion between the processing composition permeable material and the remainder of the film unit. The use of electrical discharge or other surface oxidation techniques also permits the elimination of a layer in the total film structure which would otherwise be necessary if chemical adhesion means, such as an adhesive layer, were employed.

The term "acid reacting reagent" as used herein is intended to refer to any compound which will react with the alkali in the processing composition to precipitate or neutralize the alkali or which will substantially decrease or obviate entirely the development potential of the developing agents. The term acid reacting reagent thus refers to compounds which possess acid groups and may include acids such as citric, ascorbic, or palmitic acids, salts such as cadmium acetate, lead acetate, zinc acetate, manganese acetate, and the like, acid esters such as diethyl tartrate, or polymeric acids such as, for example, the type set forth in U.S. Pat. No. 3,362,819.

When the film unit has been contacted with the processing composition and the film unit has been rolled upon itself, the processing composition will diffuse from the adjacent layers and will contact the processing composition permeable layer and the acid contained therein and will diffuse throughout the remainder of the film unit contacting the reagents and the image silver in the adjacent layers. It should be understood, however, that the acidreacting reagent be so disposed in the layer so as to delay its contact with the layers on the opposite side of the support until after substantial positive silver image has occurred. Such delay may be obtained by a predetermined thickness of the processing composition permeable layer or by the use of timing layers.

Referring to the drawings, there is shown in FIG. 1 a diagrammatic enlarged cross-sectional view of a film unit of the present invention wherein the film unit shown specifically comprises a flexible transparent film base or support member 10 carrying on a first surface thereof a substantially photoinsensitive layer 11 containing silver precipitating nuclei and a photosensitive silver halide stratum 12 which optionally may contain dispersed therethrough additional silver precipitating nuclei; and, on a second surface of said support, processing composition permeable layer 13. The film unit is shown subsequent to exposure and application of the processing composition wherein the film unit is rolled upon itself, thus contacting photosensitive layer 12 with layer 13 thereby permitting the acid associated with layer 13 to contact the materials within the layers 11 and 12 to provide the desired neutralization and stabilization effects.

Figure 2:
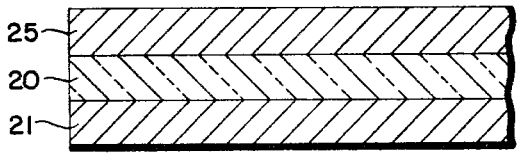
FIG. 2 is a diagrammatic enlarged cross-sectional view illustrating a photographic film unit of the present invention composed of a permanent laminate.
Figure 3:
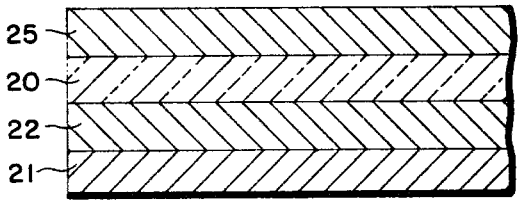
FIGS. 3, 4, 5 and 6, inclusive, are diagrammatic enlarged cross-sectional views analogous to FIG. 2 illustrating preferred film units of the present invention.
Figure 4:
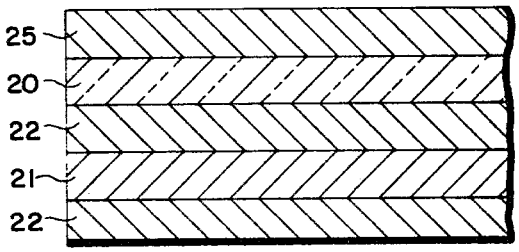
Figure 5:
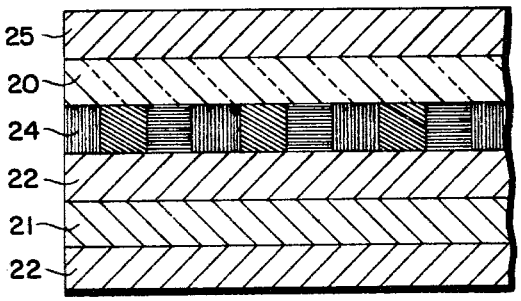
Figure 6:
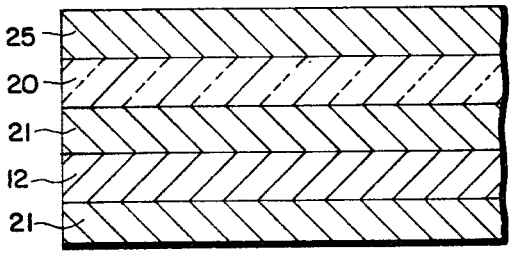

Referring to FIG. 2, there is shown a diagrammatic enlarged cross-sectional view of a film unit of the present invention. The film unit as shown specifically comprises a flexible transparent film base or support member 20 carrying on one surface thereof a photosensitive silver halide stratum 21 composed of silver halide crystals having associated therewith silver precipitating nuclei and, on the opposite surface, a polymeric layer 25 of processing composition permeable material such as hydroxyethyl cellulose containing acid reacting reagents. FIG. 3 is an alternative structure for a film unit which comprises support member 20 carrying on one surface a substantially photoinsensitive layer 22 containing silver precipitating nuclei and a photosensitive silver halide stratum 21 which optionally may contain dispersed therethrough additional silver precipitating nuclei and on the second surface a processing composition permeable layer 25 containing acid reacting reagents. FIG. 4 contains a preferred film unit wherein support 20 carries on one surface, in sequence, a first photoinsensitive layer 22, a photosensitive silver halide stratum 21, and a second photoinsensitive layer 22, and on the second surface, a layer of processing composition permeable material 25 containing acid reacting reagents. FIG. 5 contains a particularly preferred film unit for use in the present invention wherein support member 20 carries on one surface, additive multicolor screen 24 positioned intermediate support member 20 and the remaining photoinsensitive layers 22 containing silver precipitating nuclei and photosensitive layer 21 and, on the second surface, a layer of processing composition permeable material 25 containing acid reacting reagents. FIG. 6 is still another alternative film unit wherein support member 20 carries on one surface photoinsensitive layer 22 intermediate the photosensitive layers 21, and on the second surface, a layer of processing composition permeable material 25 containing acid reacting reagents.

The novel film assemblage of the present invention is particularly suitable for use as motion picture film. After exposure of the film unit, the exposed emulsion is contacted with an aqueous alkaline processing composition which preferably contains a silver halide developing agent and silver halide solvent, by passing the film continuously past a film processing station where an aqueous alkaline developing composition is applied to said exposed film strip to develop to a visible condition the images recorded on said film.

The employment of the integral film unit which is maintained as a permanent laminate permits the processing to be carried out in a variety of devices such as that disclosed in the above-mentioned U.S. Pat. No. 3,615,127.

The novel film unit of the present invention also permits the employment of relatively nonviscous, or low viscosity materials, as well as viscous, processing compositions.

In the practice oı the present invention, the silver precipitating nuclei may be disposed within the photosensitive silver halide stratum of the film unit assemblages, in a separate layer or layers contiguous one or both surfaces of the silver halide stratum and the silver halide stratum may comprise two or more silver halide strata, each optionally retaining silver precipitating nuclei, and may include a separate silver precipitating nuclei layer positioned intermediate separate silver halide strata.

Support or film bases 10 and 20 may comprise any of the various types of transparent rigid or flexible supports, for example, glass, polymeric films of both the synthetic type and those derived from naturally occurring products, etc. Especially suitable materials, however, comprise flexible transparent synthetic polymers such as polymethacrylic acid, methyl and ethyl esters; vinyl chloride polymers; polyvinyl acetals; polyamides such as nylon; polyesters such as the polymeric films derived from ethylene glycol terephthalic acid; polymeric cellulose derivatives such as cellulose acetate, triacetate, nitrate, propionate, butyrate, acetate butyrate, or acetate propionate, polycarbonates; polystyrenes; and the like. The supports employed in the present invention will be substantially impermeable to processing composition fluid.

The present invention will be illustrated in greater detail in conjunction with the following specific example which sets forth a representative fabrication of the film units of the present invention, which however, is not limited to the detailed description herein set forth but is intended to be illustrative only.

One surface of a cellulose triacetate film base may be subjected to a corona discharge of 100 KV derived from a Lepel Model HFSG-2 generator at a frequency of 450 K cps. A solution of approximately 1% polyvinyl alcohol may then be applied to the treated surface at a dry coverage of 100 mgs./ft.$^2$ having dispersed therein ascorbic acid at a coverage of 30 mgs./ft.$^2$.

The opposite surface of the cellulose triacetate film base may be subcoated with gelatin and then may be coated with a composition comprising deacetylated chitin and copper sulfide at a coverage of 4.4 mgs./ft.$^2$ deacetylated chitin and 0.25 mgs./ft.$^2$ copper sulfide. On the external surface of the preceding layer a hardened gelatino silver iodobromide emulsion may then be coated at a coverage of 200 mgs./ft.$^2$ gelatin, 100 mgs./ft.$^2$ silver and 4.0 mgs./ft.$^2$ algin. The resultant film unit may then be overcoated with a layer comprising deacetylated chitin and copper sulfide at a coverage of 6 mgs./ft.$^2$ deacetylated chitin and 4 mgs./ft.$^2$ copper sulfide.

The gelatino silver iodobromide emulsion employed may be prepared by heating a mxiture comprising 80 grams of gelatin in 880 grams of water at a temperature of about 40° C. for the period required to dissolve the gelatin. The pH of the resultant solution may be adjusted to 10±0.1 and 8.8 grams of phthalic anhydride in 61.6 cc. of acetone added to the solution over a period of 30 minutes. Subsequent to addition of the phthalic anhydride the reaction mixture may be maintained at the stated temperature and pH for a period of about 30 minutes and then adjusted to a final pH of about 6.0.

To a solution comprising 226 grams of the gelatin phthalic anhydride derivative, prepared as above, 161 grams of potassium bromide, 2 grams of potassium iodide, and 1200 grams of water may be added a solution comprising 200 grams of silver nitrate in 1600 grams of water, at a rate of about 140 cc. per minute, for a period of about 3 minutes, held 10 minutes and the addition continued for a period of about 9 minutes. The resulting emulsion may then be precipitated by reducing the pH to about 2.5–3.0 with sulfuric acid. The precipitate may then be separated from the supernatant liquid and washed until the wash water is essentially free of excess potassium bromide. Ninety-five grams of gelatin may then be added to the precipitate, the volume adjusted with water to 845 cc., and dissolved by heating to about 38° C., for about 20 minutes, at a pH of about 5–6, and about 1.0 cc. of 1,N-potassium bromide added to the emulsion. To the reaction mixture, at about 56° C., may be added about 5 cc. of a solution containing 0.1 grams of ammonium thiocyanate in 9.9 cc. of water and 0.4 cc. of a solution containing 0.097 grams of gold chloride in 9.9 cc. of water, and the mixture ripened at that temperature for about 37 hours. The resultant emulsion may then be panchromatically sensitized by the sequential addition of 0.1%, by weight, methanol solutions of anhydro 5,5'-diphenyl-3,3'-bis-(4-sulfobutyl)-9-ethyloxacarbocyanine hydroxide and anhydro 5,5'-dimethyl-3,3'-bis-(3-sulfopropyl)-9-ethyl-thiacarbocyanine hydroxide in optionally effective concentrations. The copper sulfide silver precipitating agent may be provided, prior to coating, by the in situ addition of substantially equimolar quantities of copper acetate and sodium sulfide solutions.

The film unit, fabricated as detailed above, and in the form of a motion picture film strip, may be subjected to exposing electromagnetic radiation and developed by contacting the film unit in a device similar to that disclosed in U.S. Pat. No. 3,615,127 for about 2 seconds with a processing composition comprising 180 cc. of water, 8.33 grams of sodium hydroxide, 16 grams of sodium thiosulfate, 6.48 grams of sodium sulfite, 0.42 grams of 6-nitrobenzimidazole, and 5 grams of 2,6-dimethylhydroquinone, to provide production of a positive silver image possessing the optical characteristics described hereinbefore and the acuity required for effective image reproduction and rewound upon itself substantially immediately after contact with the processing composition.

A film unit fabricated and processed in the general manner detailed above exhibited a $D_{max}$ of 3.0 and a $D_{min}$ of 0.4.

In addition to the described essential layers, it will be recognized that the film unit may also contain one or more subcoats or layers which, in turn, may contain one or more additives such as plasticizers, intermediate essential layers for the purpose, for example, of enhancing adhesion, and that one or more of the described layers may comprise a composite or two or more strata which may be contiguous or separated from each other.

Since certain changes may be made in the above product, process and apparatus without departing from the scope of the invention herein involved, it is intended that all matter contained in the above description or shown in the accompanying drawings shall be interpreted as illustrative and not in a limiting sense.

What is claimed is:

1. A photographic film unit comprising an elongated strip adapted to be rolled upon itself which comprises a permanent laminate including a common support carrying on a first surface a layer of silver precipitating nuclei in a hydrophilic binder and a layer of photosensitive silver halide crystals in a hydrophilic binder, and on a second surface, a layer of hydrophilic, processing composition permeable polymeric material having disposed therein an acid reacting reagent selected from the group consisting of ascorbic acid and a polymeric acid.

2. A product as defined in claim 1 which includes an additive color screen intermediate said common support and said silver precipitating nuclei and said photosensitive silver halide crystals.

3. A product as defined in claim 1 wherein said polymeric material is hydroxyethyl cellulose.

4. A product as defined in claim 1 wherein said processing composition permeable polymeric material is polyvinyl alcohol.

5. A product as defined in claim 1 wherein said processing composition permeable polymeric material is gelatin.

6. A product as defined in claim 1 wherein said processing composition permeable polymeric material is carboxymethyl cellulose.

7. A product as defined in claim 1 wherein said silver precipitating nuclei comprises metallic sulfides, metallic selenides, or noble metals.

8. A product as defined in claim 1 wherein said photosensitive silver halide crystals are panchromatically sensitized.

9. A photographic process which comprises, in combination, the steps of:

(a) unwinding and exposing an elongated strip of a photographic film unit comprising a permanent laminate which contains a common support carrying on a first surface a layer of photosensitive silver halide crystals in a hydrophilic binder and a layer of silver precipitating nuclei in a hydrophilic binder and on a second surface a layer of hydrophilic processing composition permeable polymeric material having disposed therein an acid reacting reagent selected from the group consisting of ascorbic acid and polymeric acid;

(b) contacting said exposed silver halide layer with an aqueous processing composition containing a silver halide developing agent and a silver halide solvent, thereby providing a visible silver image to said film unit in terms of the unexposed areas of said silver halide layer as a function of the point-to-point degree of exposure thereof;

(c) rewinding said film unit upon itself; and (d) maintaining said laminate intact subsequent to processing.

* * * * *